US005094436A

United States Patent [19]

Stephan, III

[11] Patent Number: 5,094,436

[45] Date of Patent: Mar. 10, 1992

[54] MACHINE VISE

[76] Inventor: Philip Stephan, III, 3484 W. Powers Ave., Littleton, Colo. 80123

[21] Appl. No.: 711,664

[22] Filed: Jun. 6, 1991

[51] Int. Cl.[5] ..... B25B 1/08

[52] U.S. Cl. ..... 269/153; 269/43; 269/234; 269/154

[58] Field of Search ..... 269/242, 234, 217, 157, 269/152-154, 99-101, 138

[56] References Cited

U.S. PATENT DOCUMENTS

| | | | |
|---|---|---|---|
| 620,495 | 2/1899 | Ramseaur | 269/234 |
| 2,625,861 | 1/1953 | Swanson | 269/234 |
| 4,208,045 | 6/1980 | Rowe et al. | 269/234 |
| 4,223,879 | 9/1980 | Wolfe et al. | 269/32 |
| 4,501,413 | 2/1985 | Illmann et al. | 269/234 |
| 4,529,183 | 7/1985 | Krason et al. | 269/43 |
| 4,643,411 | 2/1987 | Izumi | 269/153 |
| 4,685,663 | 8/1987 | Jorgensen | 269/244 |
| 4,804,171 | 2/1989 | Dornfeld | 269/234 |
| 4,934,674 | 6/1990 | Bernstein | 269/43 |

OTHER PUBLICATIONS

Advertising literature—Chick Bi-Lok Machine Company.

Advertising literature—Conejo Industries, Inc.

*Primary Examiner*—Robert C. Watson

*Attorney, Agent, or Firm*—Norvell E. Von Behren

[57] ABSTRACT

A machine vise for use in clamping and holding a work product having parallel and non-parallel sides. The vise is constructed with a pair of pivotal movable jaws positioned between two fixed outer jaws in the preferred embodiment. A pair of movable wedges are positioned between the movable jaws and move the jaws towards the fixed jaws. Both the movable jaws as well as the wedge blocks are mounted to pivot independently of each other. A spring bias is positioned between the movable jaws to bias the jaw action.

The vise may be constructed in a single wedge configuration and may be mounted with other similar vise configurations to provide a multiple vise configuration.

18 Claims, 4 Drawing Sheets

MACHINE VISE

BACKGROUND OF THE INVENTION

The invention relates generally to a machine vise and more particularly to a machine vise having a work holding area that will clamp parallel sided work product and nonparallel sided work product.

In the machining of a work product on a milling machine or other machine tool, the work product is held in place by a machine tool vise attached to the machine. Generally the work product has parallel sides which can be tightly clamped by parallel jaws of the vise. Some work products also have nonparallel sides which also must be accommodated in the machine vise.

While a slight degree difference of nonparallel sides can be accommodated in many machine vises, problems can occur when the degree difference becomes larger. Separate attachment devices are known to position over one of the vise jaws to handle a clamping of nonparallel sides in vises.

It is also desirable to have vises which will handle two or more work products side-by-side for multiple machining of the work product. Two-station, single action vises of the above type are typified in the U.S. Pat. No. 4,934,674, issued June 19, 1990, to L. M. Bernstein. This device uses a fixed center block with oppositely facing fixed jaws. Two outer movable jaws are positioned by operation of a vise screw controlling the combined movement of the two outer jaws. A somewhat different design of this same concept is shown in the U.S. Pat. No. 4,529,183, issued July 16, 1985 to R. P. Krason et al.

A two-station vise using centrally positioned movable jaws and outer fixed jaws is shown in the U.S. Pat. No. 4,643,411 issued Feb. 17, 1987 to M. I. Zumi. A pair of movable members are fitted in a T-shaped groove and a wedge is fitted between inclined surfaces. A tightened bolt positioned in the wedge forces the wedge downwardly to position the central movable jaws outwardly.

A two-station precision vise with independently movable jaws is shown in the U.S. Pat. No. 4,685,663, issued Aug. 11, 1987 to P. B. Jorgensen. The vise assembly uses centrally fixed stationary jaws and independently controlled outer movable jaws. A commercial version of this design is manufactured by Conejo Industries, Inc. and sold by Rovi Products Incorporated of Simi Valley, Calif.

Two-station work mounting fixtures are also known for holding two side-by-side work products. The U.S. Pat. No. 2,625,861, issued on Jan. 20, 1953, to L. Swanson is typical. The downwardly positioned wedge design is also used in many of these fixtures as can be seen in the drawings. Single-station machine tool vises using a wedge design are also known as typified in the U.S. Pat. No. 4,223,879, issued on Sept. 23, 1980 to I. E. Wofe.

It is also known to provide work holding stations for horizontal and vertical machining centers as typified by those sold by Chick Machine Co., Inc. of Butler, Pa. Work holding stations such as this may combine four double vises of the before mentioned types into a single work holding station.

While the before described work vises may have been satisfactory for their intended purpose, they do not provide the ability to tightly clamp and hold a work product that has a large degree of nonparallel sides where the product is clamped. In addition, they do not provide the ability to clamp two work products, side-by-side, both of which have nonparallel clamping surfaces.

SUMMARY OF THE INVENTION

Accordingly, in order to overcome the above described inadequacies, there is provided by the subject invention, a new and novel machine vise. The Applicant's novel vise is capable of clamping and holding at least one work product with nonparallel sides. The vise may be used, in a modular configuration, with other similarly constructed vises to form a work station of two or more vises for use in a multiple machining operation.

The subject vise is constructed with at least one pivotally mounted movable jaw opposite to a fixed jaw. The movable jaw has a tapered surface formed on the jaw which is formed in a direction facing away from the other jaw. A pivotally mounted wedge means is positioned adjacent to the tapered surface and has a wedge positioned against the tapered surface.

Moving means in the form of a right and left-hand screw are used to move the wedge away from and towards the pivotal mounting of the wedge means. The wedge moves along the same plane as the plane of the horizontal surface of the base plate supporting the device. There is also provided forcing means for positioning adjacent to the wedge means. The forcing means force the wedge against the tapered surface as the wedge moves to thereby tightly clamp the work product between the opposing jaws.

The above design may be configured as a two-station work vise by positioning the movable jaws and wedge mechanism centrally between two outer fixed jaws. The centrally positioned movable jaws are both pivotally mounted, independent from each other, and are movable towards and away from each other. The movable jaws are also spring biased with tension springs. The pivotally mounted wedge means between the two pivotally mounted movable jaws, permit the moving jaw assembly to flex or move with each movable jaw being capable of being positioned independent of the other movable jaw.

The unique design of the moving jaw assembly permits two work products to be held side-by-side. The nonparallel or parallel sides of one product being clamped will not affect the ability of the vise to clamp the other work product. In other words, the work product being held on one side of the two-station version may have parallel clamping sides. The other work product may have nonparallel sides and the novel moving jaw assembly will adjust itself to tightly clamp and hold both work products.

As a result of this novel design, the dual station version may be simply constructed with fewer operating parts that would be required with separately controlled jaws on the vise. This design also results in a quicker setup of the work products in the vise thereby reducing the setup time and ultimate cost to the purchaser of the machine product.

Accordingly it is an object and advantage of the subject invention to provide a new and novel moving jaw assembly for use in a single, double and multiple machine vise configuration which permits quick clamping of any surface having parallel and/or nonparallel sides.

Another object and advantage of the subject invention is to provide a machine vise which has two side-by-side clamping areas which operate independently of each other but have their movable jaws controlled by a single operating mechanism.

Yet another object and advantage of the invention is to provide a new and novel design of a machine vise which permits a work product with a parallel clamping surface and with a nonparallel clamping surface to be tightened in the vise simultaneously by the same operating mechanism.

A further object and advantage of the invention is to provide a novel machine vise which may be mounted to form a multiple vise work station for use in multiple machining operations.

These and other objects and advantages will become apparent from a study of the drawings and from a review of the description of the preferred embodiment hereinafter presented.

DESCRIPTION OF THE PREFERRED EMBODIMENT

Figure 1:
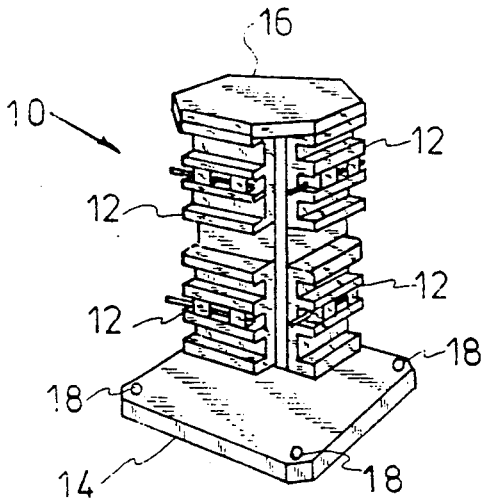
FIG. 1 is a perspective view of a vertical multiple work holding station showing how eight two-station machine vises of the Applicant's design may be positioned for use in a multiple machining operation.
Figure 2:
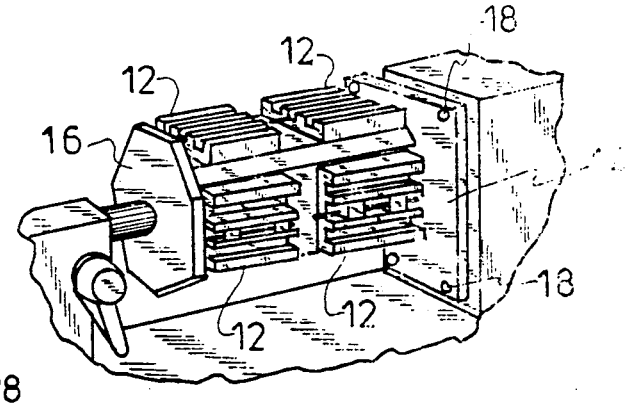
FIG. 2 is a perspective view showing how a multiple work holding station similar to the FIG. 1 station may be used horizontally on a machine.

Referring now to the drawings in general and in particular to FIGS. 1 and 2 of the drawings there is shown in FIG. 1, a perspective view of a vertical multiple work holding station generally by the numeral 10. A plurality of the Applicant's double wedge machine vise units 12 are attached to the station 10 which is formed with the lower base 14 and the upper base 16. A plurality of mounting holes 18 are formed in the lower base 14 and are used to mount the work holding station on a machine.

The work holding station shown in FIG. 1 may also be modified and mounted horizontally as shown in FIG. 2 and may be used in other various configurations of the station within the spirit and scope of the invention. The basic double wedge machine vise unit 12 is shown in the top plan view of FIG. 3 and comprises a base plate 24 having an elongated slot 26 formed therein. A pair of outer fixed jaws 28 and 30 are attached, by a keyway 54 and a pair of bolts (not shown), to the base plate 24.

A pair of pivotally mounted inner movable jaws 32 and 34 are centrally positioned between the outer fixed jaws 28 and 30. A lead screw having a right-hand thread 36 and a left-hand thread 38 is positioned between the movable jaws 32 and 34. The lead screw is positioned for rotation inside a pair of wedge blocks 40 and 42 which operates against tapered surfaces shown in dashed lines formed on the movable jaws 32 and 34 as will be described more fully hereinafter.

The pivot screws 44 and 46 are positioned through holes in the movable jaws 34 and 32 and through the elongated slot 26 and are spring biased as will be described more fully hereinafter. Referring now to FIG. 4 of the drawings there is shown a side view, taken along lines 4—4 of FIG. 3. The work pieces 48 and 50, shown in dashed lines, may then be held between the outer spaced apart fixed jaws 28 and 30 and the inner movable jaws 32 and 34. The before mentioned keyways 52 and 54 help hold the outer fixed jaws 28 and 30 fixed to the base plate 24. They may also be removed to enlarge the width of the work areas if desired when extensions and adapters (not shown) are added to the vise.

A center piece 56 is also pivotally mounted and supports the lead screws 36 and 38 which are in turn rotated on the hex end 58 by a wrench not shown. When constructed thusly, the wedge blocks 40 and 42 with the lead screw positioned therein are free to rotate around the pivotally mounted center piece 56 independently from the rotation of the inner jaws 32 and 34.

Figure 3:
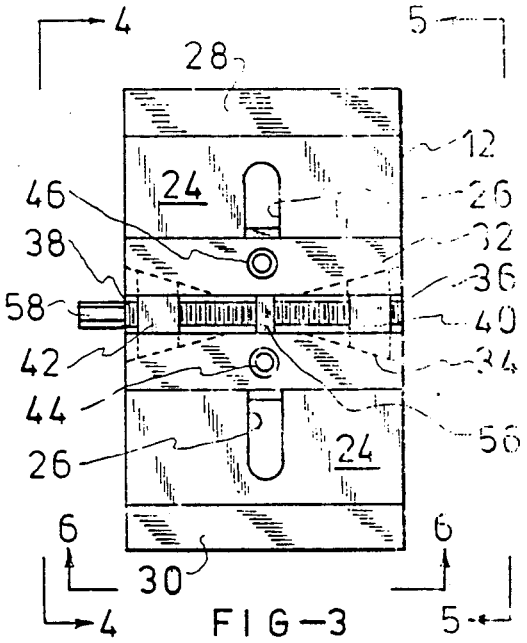
FIG. 3 is a top plan view of the Applicant's novel two-work station vise showing the centrally positioned movable jaw assembly mechanism positioned between two outside fixed jaws.
Figure 4:
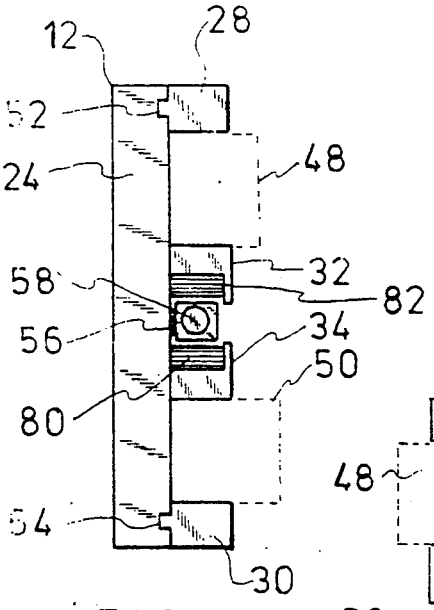
FIG. 4 is a side view taken along lines 4—4 of FIG. 3.
Figure 5:
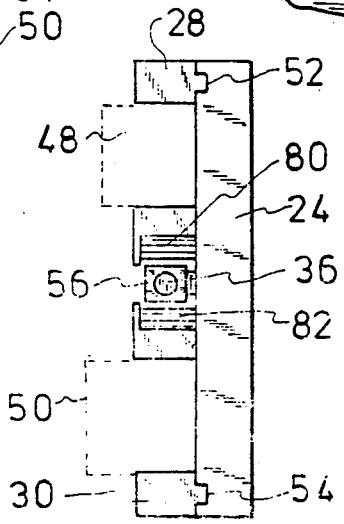
FIG. 5 is a side view, taken along lines 5—5 of FIG. 3.
Figure 6:
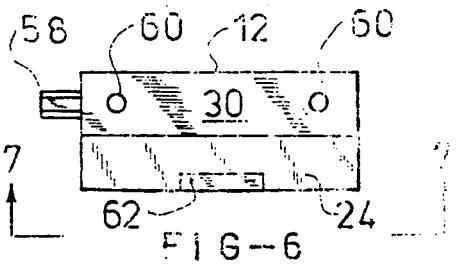
FIG. 6 is an end view, taken along lines 6—6 of FIG. 3.

Referring now to FIG. 5 there is shown in more detail a side view taken along lines 5—5 of FIG. 3. FIG. 6 also shows more detail in the end view taken along lines 6—6 of FIG. 3. A plurality of holes 60 are used for the various attachments available with the Applicant's device. A slot 62 contains the bias mechanism as will be described in FIG. 7 of the drawings.

Figure 7:
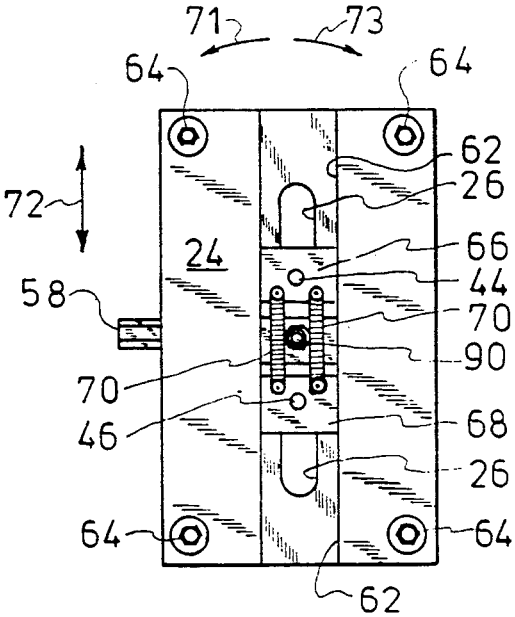
FIG. 7 is a bottom plan view of the Applicant's novel two-station machine vise, taken alomg lines 7—7 of FIG. 6, showing the pivotal mounting of the movable jaws and the wedge means and also showing the spring bias tension springs.
Figure 9:
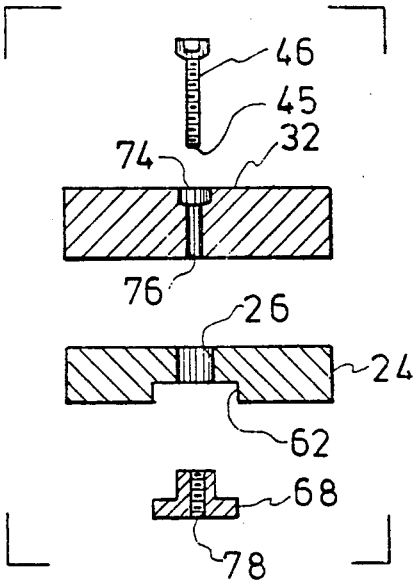
FIG. 9 is an exploded view, in brackets, and taken along lines 9—9 of FIG. 8, showing the pivotal mounting of the movable jaw assembly and how both movable jaws are mounted.

FIG. 7 is a bottom plan view, taken along lines 7—7 of FIG. 6, and shows the pivotal mounting of the movable jaws and the wedges. As before described, a plurality of screws 64 hold the fixed outer jaws 28 and 30 in the keyways 52 and 54. A pair of sliding blocks 66 and 68 are movably mounted in the elongated slot 62. The ends 45 of the screws 44 and 46 are positioned in drilled and tapped holes in the sliding blocks 66 and 68 as shown in FIG. 9 of the drawings.

When assembled thusly, the movable jaws are free to rotate or pivot around the pivot screws 44 and 46 in the directions shown by the arrows 71 and 73. In addition, the movable jaws 32 and 34 are able to move inwardly and outwardly in the direction of the arrow 72. A pair of tension springs 70 bias the movable jaws 32 and 34 toward each other whenever a work product is removed from the vise.

Figure 8:
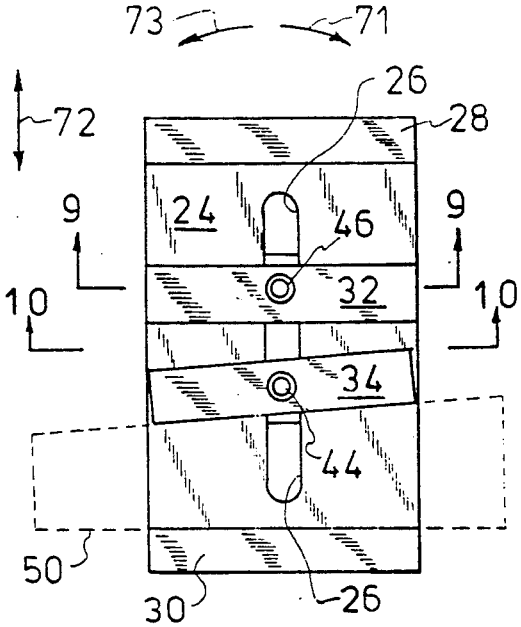
FIG. 8 is a top plan view, similar to the plan view of FIG. 3, with the wedge means removed to show the tapered construction on the movable jaws.

Referring now to FIG. 8 of the drawings there is shown a top plan view, similar to the plan view of FIG. 3 with the wedges removed from between the movable jaws 32 and 34 in order to provide more detail. As before described, each inner movable jaw 32 and 34 is pivotally mounted on the base plate 24 and is free to rotate in two directions 71 and 73 as well as outwardly and inwardly in the direction of the arrows 72.

In FIG. 8, the upper movable jaw 32 is shown positioned so that it could be used to clamp a work product having parallel clamping sides. The lower jaw 34 is shown in a tilted position to represent the position it may be called on to clamp a work product such as the dashed lines 50 with nonparallel clamping sides. When clamping both a parallel sided and a nonparallel sided work product side-by-side, the self-adjusting feature of the design permits the inner movable jaws 32 and 34 to rotate and move outwardly and/or inwardly to the proper position to tightly clamp both work pieces.

Figure 10:
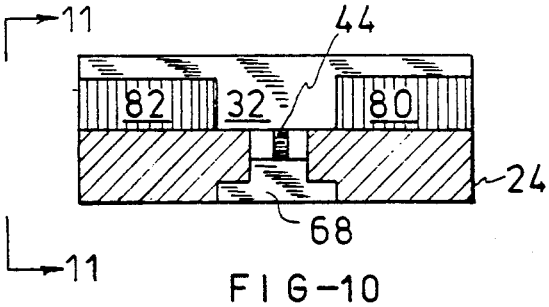
FIG. 10 is a cross-sectional view taken along lines 10—10 of FIG. 8.
Figure 11:
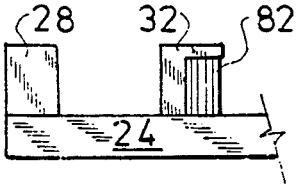
FIG. 11 is a side view taken along lines 11—11 of FIG. 10.

Referring now to FIGS. 9–11 there will be described in more detail, the pivotal mounting of the movable jaws 32 and 34. FIG. 9 is an exploded view, in brackets, taken along lines 9—9 of FIG. 8, showing the pivot screw 46 positioned through drilled holes 74 and 76 in the movable jaw 32. While FIG. 9 is taken through the movable jaw 32, the same construction of FIG. 9 would also apply to the movable jaw 34.

In FIG. 9 it can be seen how the base plate 24 contains an elongated slot 26 as well as the elongated slot 62. The sliding block 68 having a drilled and tapped hole 78 formed therein receives the pivot screw 46 to loosely hold the movable jaw 32 onto the base plate 24 so that it is free to pivot and also so that the sliding block 68 is free to slide in the elongated slots 26 and 62.

Referring now to FIGS. 10 and 11 there is shown detail of the construction of a tapered surface 80 and 82 on the sides of the movable jaws 32 and 34 which face each other. The wedges 40 and 42 are in juxtaposition to these tapered surfaces and the turning of the lead screws 36 and 38 move the wedges along the plane of the base plate surface to tighten or loosen the wedges on the work product.

Figure 12:
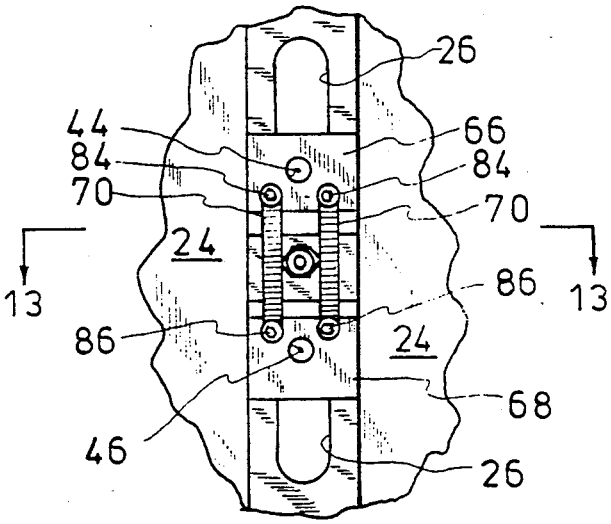
FIG. 12 is an enlarged portion of the central mounting assembly shown in FIG. 7.

FIG. 12 is an enlarged portion of the bias mounting shown in FIG. 7 and a pair of screws 84 and 86 are positioned in drilled and tapped holes, not shown, in the sliding blocks 66 and 68. The ends of the tension springs 70 are positioned around the screws 84 and 86 to permit the tension bias or the influence to pull the movable jaws together.

Figure 13:
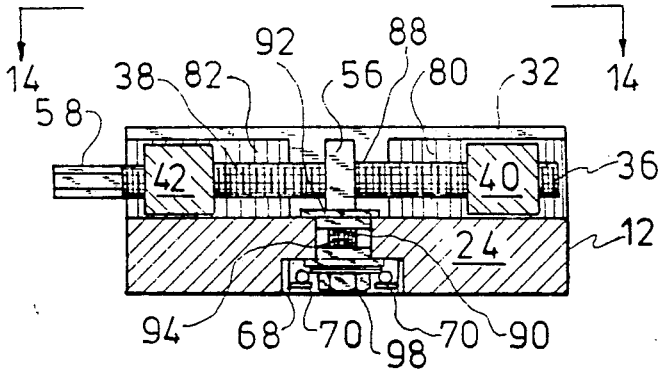
FIG. 13 is a cross-sectional view, taken along lines 13—13 of FIG. 12.

Referring now to FIG. 13 of the drawings there is drawn a cross-sectional view, taken along lines 13—13 of FIG. 12 and showing more details of the pivotal mounting of the wedges 40 and 42 on the base plate 24. The center piece 56 is formed with a central hole 88, which can also be seen in FIG. 17, and a threaded end 90. A pair of brackets 92 and 94 have central holes 96 for positioning the threaded end 90 through the holes. A nut 98 is screwed onto the threaded end 90 and holds the assembly in the position shown in FIG. 13.

Figure 16:
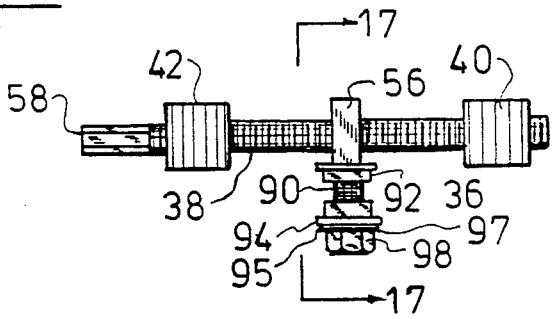
FIG. 16 is a side view taken along lines 16—16 of FIG. 14.
Figure 17:
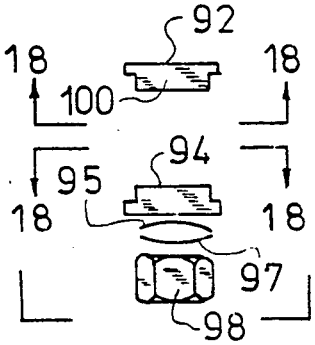
FIG. 17 is an exploded view, in brackets, taken along lines 17—17 of FIG. 16, showing the pivotal mounting assembly for the wedge means.

By referring to FIG. 17 there is shown an exploded view in brackets taken along lines 17—17 of FIG. 16 and giving more details on the assembly construction. The surfaces 100 and 102 ride in the elongated slot 26 above the elongated slot 62. A pair of Belleville washers 95 and 97 provide bias to the assembly to pull the unit together.

Figure 14:
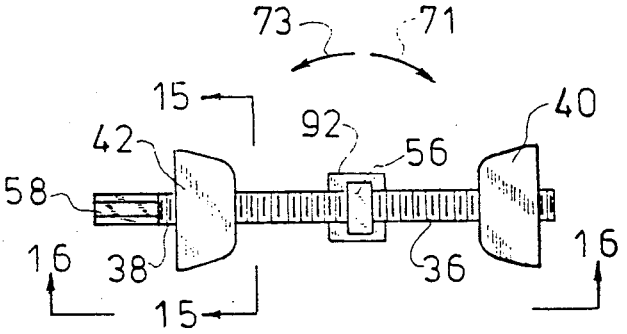
FIG. 14 is a top plan view of the wedge means, taken along lines 14—14 of FIG. 13, showing the wedge means removed from the movable jaws.

Referring now back to FIGS. 14–17 there is shown more detail on the wedge means assembly. FIG. 14 is a top plan view of the wedge means, taken along lines 14—14 of FIG. 13 and shows the wedge means removed from the movable jaws 32 and 34 and standing alone. As before described, the wedge means is pivotally mounted on the base plate 24 and can rotate in both directions 71 and 73 in a manner similar to the movement of the inner movable jaws.

Figure 15:
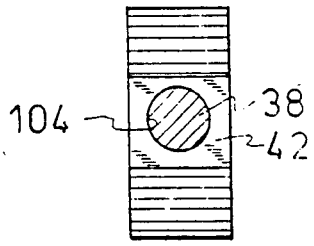
FIG. 15 is an enlarged cross-sectional view taken along lines 15—15 of FIG. 14.

FIG. 15 is a cross-sectional view taken along lines 15—15 of FIG. 14 and shows how the drilled and tapped hole 104 is formed in the wedge blocks 40 and 42 to permit the wedges blocks to advance on the lead screw. The left-hand lead screw 38 would be formed in the preferred embodiment shown with a ⅝" diameter-11 pitch thread while the right-hand lead screw 36 would be also formed of a ⅝" diameter-11 pitch thread.

Figure 19:
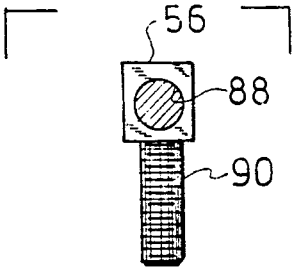
FIG. 19 is a side view of the lead screw used in the movable jaw assembly.
Figure 19:
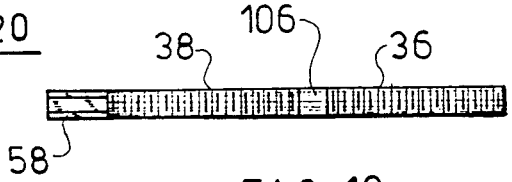
Figure 18:
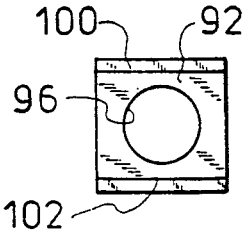
FIG. 18 is a bottom plan view taken along lines 18—18 of FIG. 17 of both brackets 92 and 94.

FIG. 16 is a side view, taken along lines 16—16 of FIG. 14 and shows more detail of the assembly., In a similar manner the lead screw 36 and 38 is shown in FIG. 19 and has a central portion 106 which is positioned inside the hole 88 formed in the center piece 56. A pair of Belleville washers are positioned between the bracket 94 and the threaded nut 98.

Figure 20:
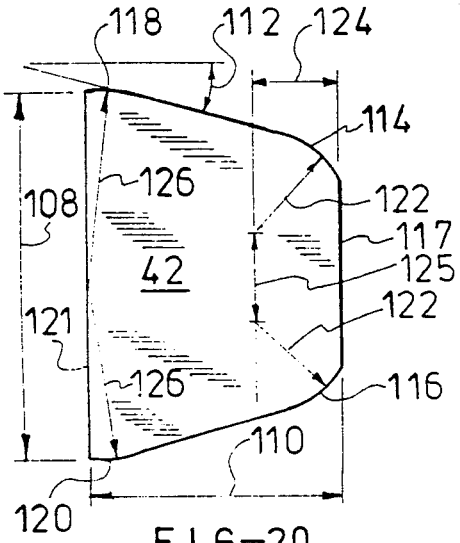
FIG. 20 is an enlarged top view of one of the wedges used in the wedge means of the movable jaw assembly, the other wedge being constructed in the same manner.

Referring now to FIG. 20, there is shown an enlarged top view of one of the two similar wedge blocks 40 and 42. The wedge blocks in the preferred embodiment are constructed approximately 1¾" wide as shown by the numeral 108 with a length of approximately 1.125" as shown by the numeral 110. The wedge angle, shown by the numeral 112 on both sides of each wedge would be approximately 15 degrees. This angle of 15 degrees would also be the angle of the tapers 80 and 82 on the inner movable jaws 32 and 34. It is within the spirit and scope of the invention that this angle could also range from approximately 10 degrees to 20 degrees for different sizes and configurations of the jaw/wedge assembly.

Since the wedge assembly is free to rotate or pivot with the pivoting of the movable jaws 32 and 34, it is preferable to provide a radius 114 and 116 on the end 117 of the wedges 40 and 42. In addition, a radius 118 and 120 is formed on the opposite end 121 of the wedges. These radii 114 and 116 would be approximately 0.468" as shown by the numeral 122. They would be positioned a distance of approximately 0.4" as shown by the numeral 124 and would be spaced apart approximately 0.340 inches as shown by the numeral 125. The radii 118 and 120 would be approximately 1" as shown by the numeral 126.

When the radii are constructed in this manner, the radius 114, 116, 118 and 120 on the wedge blocks 40 and 42 would prevent wear at these points when the vise's movable jaws are holding a nonparallel work product.

Figure 21:
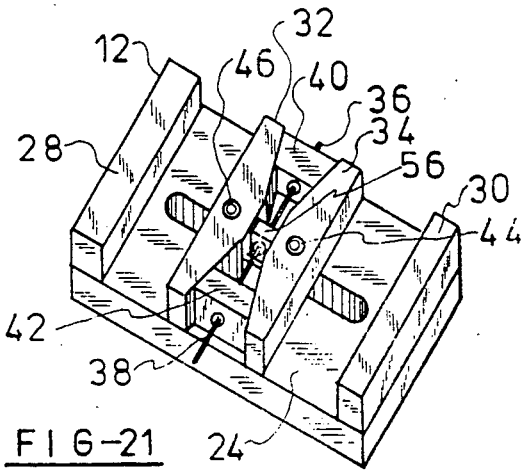
FIG. 21 is a perspective view of the Applicant's basic two-work station vise.
Figure 22:
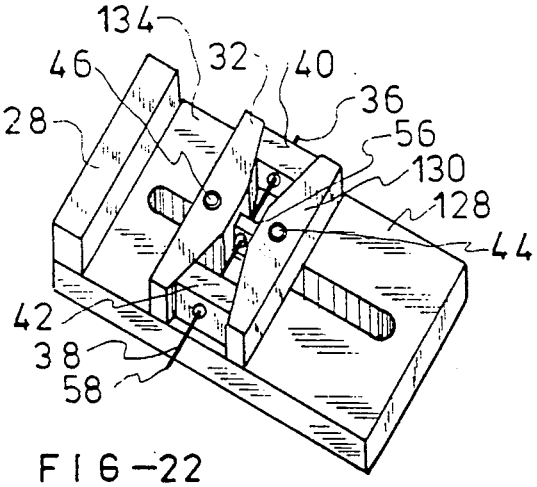
FIG. 22 is a perspective view of the Applicant's basic design used as a single work station vise.

Referring now to FIGS. 21 and 22, there are shown perspective views of the Applicant's double wedge vise in FIG. 21 with a modification thereof being shown in FIG. 22 having a single wedge construction. The double wedge vise of FIG. 21 has been previously described and there will now be detailed the single wedge modification of FIG. 22. The modified base plate 128 is formed with one outer fixed jaw 28 and without the other fixed jaw 30 as used in the double wedge configuration.

The inner movable jaw assembly of the single wedge configuration is the same as used in the double wedge construction of FIG. 21. The inner moveable jaw 130 may be converted to a fixed position jaw by tightening the screw 44 to firmly hold the jaw in place so that it cannot be moved. This would then have the effect of changing the jaw 130, after the screw 44 was tightened, to a fixed jaw. As a result the jaw 130 would then serve as a forcing means to force the wedges 40 and 42 against the tapered surfaces 80 and 82 as the wedges are moved to thereby tightly clamp the work product between the opposing jaws 12 and 32.

It may also be desired to convert the inner moveable jaw 130 into a fixed jaw by other known means such as using pins, slots etc. within the spirit and scope of the invention. When the inner jaw is converted to a fixed jaw as before described, the action of the wedge blocks 42 and 40 on the tapers 80 and 82 act to force the movable jaw 32 against the work product in the work area 134 and against the fixed jaw 28 as the lead screws 36 and 38 are turned by the hex end 58 in this modification.

Figure 23:
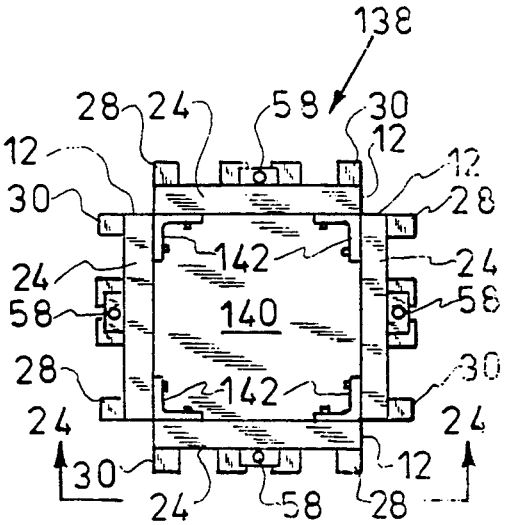
FIG. 23 is a top plan view showing how four of the basic two-work station vises can be combined in a modular construction and can be fixedly attached to a base plate.
Figure 24:
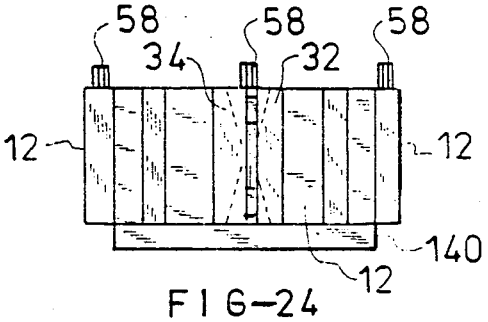
FIG. 24 is a side view taken along lines 24—24 of FIG. 23.

Referring now to FIGS. 23 and 24 of the drawings, there is shown a modular setup 138 using four of the basic dual station machine vises 12 positioned and fixed to a base plate 140. The machine vises 12 are fixedly held together by adapter brackets 142 which are attached to the base plate and to the machine vises by known attaching means. When formed thusly, the modular setup 138 will hold four dual station vises 12 for a total of eight work product areas that can be clamped.

The single station vise shown in FIG. 22 may also be used in this configuration. FIG. 24 shows a side view taken along lines 24—24 of FIG. 23 and illustrates how the lead screw hex ends 58 of the machine vises 12 would be preferably positioned upwardly in the vertical direction shown.

From the foregoing it can be seen how the subject invention accomplishes all of the objects and advantages hereinbefore described by the provision of the novel machine vise shown in the drawings along with its modifications. While the preferred embodiment and modifications have been given by way of illustration, it is within the spirit and scope of the invention that other constructions and arrangements of the various parts along with modifications are possible and the Applicant is not to be limited to the exact embodiment shown and described.

Having described my invention I claim:

1. A machine vise for use for clamping and holding two work products between opposing jaws of the vise, comprising:

(a) a base plate having opposite sides;

(b) a first outer fixed solid jaw, attached to the base plate on one side thereof;

(c) a second outer fixed solid jaw, attached to the base plate of the opposite side thereof;

(d) a pair of spaced apart movable jaws positioned between the first and second outer fixed solid jaws, (1) each movable jaw pivotally mounted on the base plate, (2) the movable jaws being spaced apart to form a central space between each other;

(3) each movable jaw having formed thereon at least one tapered surface facing the tapered surface on the other movable jaw;

(4) each movable jaw and the adjacent fixed solid jaw being spaced apart to form a work clamping area for a work product;

(e) wedge means, positioned in the central space between the pair of spaced apart movable jaws;

(1) moving means associated with the wedge means, for moving the wedges towards and away from each other on the tapered surfaces as desired;

(2) the wedge means pivotally mounted on the base plate for pivotally moving with the tapered surfaces on the movable jaws as the movable jaws pivot; and (f) bias means, associated with the pair of spaced apart movable jaws, for biasing the movable jaws towards each other.

2. The machine vise as defined in claim 1 wherein each movable jaw has formed thereon two tapered surfaces.

3. The machine vise as defined in claim 1 wherein the moving means comprise a lead screw positioned inside the wedge means for mating engagement with a thread formed inside the wedge means.

4. The machine vise as defined in claim 1 wherein the bias means comprise a pair of tension springs.

5. The machine vise as defined in claim 1 wherein the wedge means comprises a pair of spaced apart wedges having a central threaded opening formed therein and the moving means comprises a dual right-hand and left-hand lead thread screw positioned within the central openings for moving the wedges on the lead screw.

6. The machine vise as defined in claim 5 wherein the dual lead screw has opposite threads on each end separated by a central nonthreaded area so that the pair of wedges move apart and together on the lead thread screw as the screw is turned in one direction and in the opposite direction.

7. The machine vise as defined in claim 1 wherein at least four of the devices are fixedly attached together to form a multiple four-position work station.

8. The machine vise as defined in claim 1 wherein at least eight of the vises are fixedly attached together to form a multiple eight-position work station.

9. A vise for clamping and holding at least one work product between opposing jaws of the device, comprising:

(a) a base plate having opposite sides;

(b) an outer fixed jaw attached to the base plate on one side thereof;

(c) an outer fixed retainer means, attached to the base plate on the opposite side thereof;

(d) at least one movable jaw, positioned between the outer fixed jaw and the outer fixed retainer means,
(1) the movable jaw pivotally mounted on the base plate,
(2) the movable jaw being spaced apart from the outer fixed retainer to form a central space between the movable jaw and the fixed retainer,
(3) the movable jaw having formed thereon at least one tapered surface facing the fixed retainer,
(4) the movable jaw and outer fixed jaw being spaced apart to form a work clamping area for a work product;

(e) wedge means, positioned in the central space between the movable jaw and the outer fixed retainer means,
(1) moving means, associated with the wedge means, for moving the wedge means against the tapered surface as desired,
(2) the wedge means pivotally mounted on the base plate for pivotally moving with the tapered surface on the movable jaw as the movable jaw pivots;

(f) bias means, associated with the movable jaw to bias the action of the movable jaw as a work product is positioned in the vise.

10. In a vise, having a base plate and being used for clamping and holding at least one work product between opposing jaws of the vise, the improvement comprising:
(a) at least one of the jaws being pivotally mounted on the base plate having a horizontal surface and having a tapered surface formed in a direction facing away from the other jaw;
(b) a pivotally mounted wedge means assembly positioned adjacent to the tapered surface and having a wedge mounted on the wedge means assembly, the wedge being positioned against the tapered surface,
(c) moving means, associated with the wedge means assembly, for moving the wedge towards and away from the pivotal mounting of the wedge means assembly along the same plane as the plane of the horizontal surface of the base plate of the device; and
(d) forcing means, positioned adjacent to the wedge means assembly to force the wedge against the tapered surface as the wedge moves to thereby tightly clamp the work product between the opposing jaws.

11. The improvement as defined in claim 10 wherein the vise has two fixed jaws and two pivotally mounted jaws, each pivotally mounted jaw having a tapered surface formed thereon, the tapered surface of the pivotally mounted jaws facing each other and being spaced apart from each other, the jaws being positioned centrally between two spaced apart fixed jaws and the pivotally mounted wedge means assembly and the moving means are positioned between the two pivotally mounted jaws, the forcing means being formed as a part of one of the pivotally mounted jaws.

12. A multiple four-position work station for use with a machine tool, comprising:
a. a base plate;
b. a plurality of machine vises fixedly attached to each other and to the base plate and positioned in four different planes to form a cubic configuration;
(1) each machine vise having at least one work product holding portion for holding parallel and nonparallel sides of a work product in the machine vise around the different planes of the cubic configuration;
(2) each machine vise being formed with at least one fixed jaw and at least one pivoted movable jaw, the movable jaw being mounted so that the movable jaw may pivot on the base plate;
(3) moving means for moving the movable jaw against and away from the fixed jaw; and
(4) spring bias means, fixedly attached to the movable jaw and not formed integrally with the moveable jaw for influencing the action of the movable jaw to move away from the fixed jaw.

13. The work station as defined in claim 12 wherein each machine vise has two work product holding portions thereby providing a total of eight work product holding portions in the cubic configuration.

14. A pivotally mounted moving jaw assembly for positioning on a base plate and for use in a machine vise designed for handling at least one work product that may have parallel sides or may have non-parallel sides comprising:
(a) a pair of spaced apart jaws having at least one tapered surface formed thereon and facing the tapered surface on the other jaw;
(b) at least one wedge positioned between the spaced apart jaws and in juxtaposition with the tapered surfaces on the pair of spaced apart jaws;
(c) moving means, associated with the wedge for moving the wedge to force the spaced apart jaws outwardly and inwardly as desired;
(d) spring bias means, associated with the spaced apart jaws to pull the jaws together; and
(e) means, associated with the spaced apart jaws, and the base plate, to pivot at least one of the jaws on the base plate so that the pivoted jaw will be able to grip a non-parallel sided work product as well as a parallel sided work product.

15. The moving jaw assembly as defined in claim 14 wherein the pair of spaced apart jaws have two tapered surfaces formed thereon and the assembly has two wedges positioned between the spaced apart jaws in juxtaposition with the two tapered surfaces.

16. The moving jaw assembly as defined in claim 15 wherein the moving means comprises a right-hand and a left-hand lead screw positioned inside the two wedges for mating engagement with a thread formed inside each wedge.

17. The moving jaw assembly as defined in claim 16 wherein the spring bias means comprises a pair of tension springs fixedly attached to each spaced apart jaw.

18. A pivotally mounted moving jaw assembly for use in a machine vise designed for handling multiple work products that may have parallel sides, non-parallel sides or a combination of both types of sides, comprising:
(a) a pair of spaced apart, pivotally mounted jaws having at least one tapered surface formed thereon and facing the tapered surface on the other jaw;
(b) a pair of wedges positioned between the spaced apart jaws and in juxtaposition with the tapered surfaces on the pair of spaced apart jaws;
(c) a pivotally mounted screw shaft, positioned within the wedges for moving the wedges to force the spaced apart jaws outwardly and inwardly as desired so that the jaws are positioned against the parallel and/or non-parallel sides of the work products;

(d) spring bias means, associated with the spaced apart jaws to pull the jaws together against the pair of wedges; and (e) the pivotal movement of the pair of wedges and the screw shaft along with a rotational movement of the screw shaft allowing the wedges and the shaft to move both radially around the pivotal mounting of the screw shaft and towards and/or away from the pivotal mounting of the screw shaft so that the jaws will adjust to and assume the position of the side of the work product adjacent to the jaws.

* * * * *